United States Patent [19]

Quang et al.

[11] Patent Number: 4,613,554

[45] Date of Patent: Sep. 23, 1986

[54] PROCESS FOR DEVELOPING A LATENT IMAGE FORMED ON A MAGNETIC SURFACE, DEVICE FOR CARRYING OUT THE PROCESS AND PRINTING APPARATUS CONTAINING THE SAID DEVICE

[75] Inventors: Pham K. Quang, Dieppe, France; Donald H. M. Kings, Rochester, N.Y.

[73] Assignee: Rhone-Poulenc Systemes, France

[21] Appl. No.: 609,008

[22] Filed: May 10, 1984

[30] Foreign Application Priority Data

May 11, 1983 [FR] France ..... 83 08097

[51] Int. Cl.[4] ..... G03G 13/00

[52] U.S. Cl. ..... 430/39; 118/657; 430/106.6

[58] Field of Search ..... 430/39; 118/657

[56] References Cited

U.S. PATENT DOCUMENTS

| | | | |
|---|---|---|---|
| 3,043,685 | 7/1962 | Rosenthal | 118/636 |
| 3,133,834 | 5/1964 | Sowiak | 118/657 |
| 3,601,001 | 8/1971 | Preckshot | 118/636 |
| 3,640,247 | 2/1972 | Mason et al. | 118/637 |
| 3,678,895 | 7/1972 | Ohta et al. | 118/637 |
| 3,698,005 | 10/1972 | Nacci et al. | 346/74 MT |
| 4,015,561 | 4/1977 | Howard et al. | 118/657 X |
| 4,122,209 | 10/1978 | Kinard | 430/39 X |
| 4,226,524 | 10/1980 | Hashimoto | 118/657 X |
| 4,266,868 | 5/1981 | Bresina et al. | 118/657 X |
| 4,368,687 | 1/1983 | Kanbe et al. | 430/39 X |

FOREIGN PATENT DOCUMENTS

| | | |
|---|---|---|
| 986844 | 3/1965 | United Kingdom . |
| 1217281 | 12/1970 | United Kingdom . |
| 1273456 | 5/1972 | United Kingdom . |
| 1300865 | 12/1972 | United Kingdom . |
| 1417006 | 12/1975 | United Kingdom . |
| 1533933 | 11/1978 | United Kingdom . |

*Primary Examiner*—John D. Welsh

*Attorney, Agent, or Firm*—Sherman and Shalloway

[57] ABSTRACT

The invention relates to a process and a device for developing a latent image formed on a magnetic surface, by means of a magnetic developing powder, in order to form a powder image.

The device contains means (2) for causing the powder (4) to flow onto the magnetic surface (1) uninfluenced by a magnetic field other than that of the magnetic surface (1). These means can consist of magnetic means (3) for taking the powder (4) from a trough (5), means (6) for detaching the powder (4) from the magnetic means (3), and means (7) for bringing the powder (4) into the vicinity of the magnetic surface (1).

This developing device can be used in a printing apparatus containing means for transferring a powder image onto a substrate.

28 Claims, 4 Drawing Figures

PROCESS FOR DEVELOPING A LATENT IMAGE FORMED ON A MAGNETIC SURFACE, DEVICE FOR CARRYING OUT THE PROCESS AND PRINTING APPARATUS CONTAINING THE SAID DEVICE

The present invention relates to a process for developing a latent image formed on a magnetic surface, by means of a magnetic developing powder, in order to form a powder image. The invention also relates to a device for carrying out the process and to a printing apparatus containing this device.

The technique of printing documents from a latent image formed on a magnetic surface is related to the technique of printing from a latent image formed on a photoconductive surface.

The printing of documents from a latent image formed on a magnetic surface consists essentially in:

first creating a latent image by means of variations in magnetic field on a magnetic surface having a uniform magnetic field on its surface, for example with the aid of magnetic recording heads connected to a source of information, or by means of a variation in magnetic field on a particular surface having a low Curie point, the said variation being brought about by local heating, for example by means of a laser connected to a source of information. The latent image created represents the information received, which may be a text, drawings or the like, developing the latent image formed in this way, with the aid of a magnetic developing powder, the particles of the developing powder being retained by the latent image in order to form a powder image, and transferring the resulting powder image onto a substrate such as paper.

Processes and devices for developing latent images formed on magnetic surfaces are described, for example, in the French patents and patent applications registered under the following numbers: 76/08,424, 77/31,966, 78/11,216 and 79/04,616.

The French patent registered under No. 76/08,424, published under No. 2,305,764, relates to a magnetic printing machine containing a magnetic brush of a particular structure for transferring the developing powder into the vicinity of the magnetic drum in order to develop the latent image formed on the magnetic surface. The structure of the magnetic brush is such that the components of the magnetic field created by the magnetic brush are greatly reduced at the magnetic surface so as not to erase the latent image formed on the magnetic surface.

This structure is satisfactory from the point of view of faithfully reproducing the latent image, but the printing machine according to the said patent does not contain any means for removing the excess developing powder which may be present in the powder image zone, before it is transferred onto a substrate.

The French patents registered under Nos. 77/31,966 and 78/11,216, published respectively under Nos. 2,408,462 and 2,388,317, describe more particularly devices for developing a latent image on a magnetic surface in which the developing powder is taken from a reservoir by a magnetic brush located underneath the magnetic surface, and transferred so as to develop the latent image formed on the magnetic surface. In these devices, so that the latent image is not damaged by the magnetic field created by the magnetic brush, the latter is at a distance from the magnetic surface and a ramp is placed between the magnetic brush and the magnetic drum in order to bring the developing powder up to the latent image present on the magnetic drum. Furthermore, in devices of this type, the magnetic brush rotates at a relatively high speed so as to enable the powder to rise towards the magnetic surface, which facilitates the escape of the powder into the printing apparatus.

The developing devices according to these patents are also not provided with means for removing the excess developing powder which may be present in the powder image zone, before it is transferred onto a substrate.

The French patent application registered under No. 79/04,616, published under No. 2,449,911, describes a process and a device for developing a latent image formed on a magnetic surface in which the magnetic surface itself takes the developing powder from a reservoir by passing in contact with the developing powder contained in the latter.

With this device, there is of course no danger that the latent image will be damaged by a magnetic field, since it does not contain a magnetic brush, but the device has the disadvantage of not allowing the developing powder to be mixed in the reservoir and of not allowing the excess developing powder in the powder image zone to be removed before it is transferred onto a substrate.

The invention relates to a developing process and a device for carrying it out which avoid the disadvantages of the processes and devices according to the prior art.

One subject of the invention is a developing process and a device for carrying it out which allow good mixing of the developing powder.

Another subject of the invention is a developing process and a device which allow the excess developing powder present in the powder image zone to be removed before it is transferred onto a substrate.

Yet another subject of the invention is a developing process and a device which, although using magnetic means, do not damage either the latent image or the powder image.

A process for developing a latent image formed on a magnetic surface, by means of a magnetic developing powder, in order to form a powder image, has now been found which is characterized in that the said powder is caused to flow freely onto the magnetic surface uninfluenced by a magnetic field other than the magnetic field present on the magnetic surface.

The expression "to flow freely" is understood as meaning to flow only under the action of gravity, without the intervention of any other force.

In the present text, the term "magnetic surface" makes no assumptions about its geometrical shape. For example, the magnetic surface can be in the form of a flexible tape, which may or may not be endless, or most frequently in the form of a cylindrical surface generally having a circular directrix, which is commonly called a "magnetic drum".

The developing powder consists of particles of a metal oxide, for example iron oxide, coated with a resin which can contain particular adjuvants for improving the fluidity of the developing powder or the fixing properties, or alternatively for modifying its filler.

The developing powder is formed of very fine and extremely mobile particles and it must be handled cautiously so that it does not escape into the whole of the printing apparatus. Thus, in the process forming the subject of the invention, the powder is first taken from a trough by magnetic means, detached from the said means and, when detached, brought into the vicinity of the magnetic surface so that it flows freely onto the magnetic surface.

The quality of the printing on a substrate surface depends largely on the quality of the powder image. The latter must have sharp edges and must not contain too much developing powder, and, in addition, those parts of the magnetic surface which do not have a latent image must be free of developing powder. To obtain a powder image of good quality in the process forming the subject of the invention, the excess powder is removed from the powder image by transferring the said excess from the magnetic surface to another magnetic means under the influence of the magnetic field of the said other means.

In one embodiment of the process according to the invention, the developing powder is taken from a trough by a first magnetic means, the said powder is transferred to a second magnetic means, the said powder is detached from the said second magnetic means and, when detached, the powder is brought into the vicinity of the magnetic surface uninfluenced by the said first and second magnetic means, and the excess powder is removed from the powder image by transferring the said excess from the magnetic surface to the first magnetic means under the influence of the magnetic field of the said first means.

In another embodiment of the process forming the subject of the invention, the developing powder is taken from a trough by a first magnetic means, the powder is detached from the said first magnetic means and, when detached, the powder is brought into the vicinity of the magnetic surface so that it flows freely onto the magnetic surface uninfluenced by a magnetic field other than the magnetic field present on the magnetic surface, and the excess powder is removed from the powder image by transferring the said excess from the magnetic surface to another magnetic means under the influence of the said other magnetic means, and the powder recovered by the said other magnetic means is detached and recycled to the said first means.

The present invention also relates to a device for developing a latent image formed on a magnetic surface, by means of a magnetic developing powder, in order to form a powder image, which device carries out the process according to the invention.

The device for carrying out the process according to the invention at least contains means for causing the said powder to flow onto the magnetic surface uninfluenced by a magnetic field other than that present on the magnetic surface.

In the device forming the subject of the invention, the means for causing the powder to flow onto the magnetic surface contain magnetic means for taking the powder from a trough, means for detaching the powder from the said magnetic means, and means for bringing the powder into the vicinity of the magnetic surface.

Advantageously, the device is such that the means for detaching the powder from the magnetic means, and the means for bringing the powder into the vicinity of the magnetic surface, consist of a channel whose general shape is inclined towards the magnetic surface and of which the edge opposite the magnetic surface is a doctor for the magnetic means.

The magnetic means can consist, for example, of a magnetic brush or of a tape, for example made of magnetic rubber or formed of a textile ribbon, or made of film covered with a magnetic coating. The magnetic means preferably consist of at least one magnetic brush.

In one embodiment, the device according to the invention contains a magnetic brush which is such that part of its outer surface is in contact with a developing powder contained in a trough.

In another embodiment, the device forming the subject of the invention can contain two magnetic brushes placed in such a way that the second brush is located at a greater height than the first brush, that the magnetic field generated by the first brush on the surface of the second brush is weaker than the coercive field on the surface of the second brush, and that part of the outer surface of the first brush is in contact with a developing powder contained in a trough.

In a variant of this embodiment, the two magnetic brushes can have identical coercive fields.

In another variant of this embodiment, the two magnetic brushes can have different coercive fields.

Advantageously, the device according to the invention contains means for guiding the developing powder as it passes from the first magnetic brush to the second.

The guide means preferably consist of a ramp inclined approximately along the inner tangent to the two magnetic brushes.

In order to make it possible to obtain a powder image of good quality, the device forming the subject of the invention also contains means for removing the excess developing powder from the powder image.

In one embodiment of the device according to the invention, the means for removing the excess developing powder from the powder image can consist of another magnetic brush.

In another embodiment, they can consist of the first magnetic brush.

A device according to the invention for developing a latent image on a magnetic surface is particularly valuable for use in developing the latent image formed in a printing apparatus containing means for transferring a powder image onto a substrate such as, for example, paper, the said powder image resulting from the developing of a latent image with the aid of a developing powder, by means of the device forming the subject of the invention, using the process also forming the subject of the invention.

The invention will be understood more clearly with the aid of the description of the attached figures, which illustrate schematically, and with no fixed scale, various embodiments of the device, forming the subject of the invention, for developing a latent image formed on a magnetic surface, by means of a magnetic developing powder.

In the present text, by way of convenience, the various embodiments of the developing device forming the subject of the invention, described below and shown by the attached figures, are such that the magnetic surface is a cylindrical surface with a circular directrix, and that the magnetic means are magnetic brushes, the magnetic surface and the magnetic brushes being placed in such a way that their axes are parallel.

Also by way of convenience, in the description of the various embodiments of the developing device according to the invention, shown by the figures below, homologous elements will be given the same reference numbers.

Figure 1:
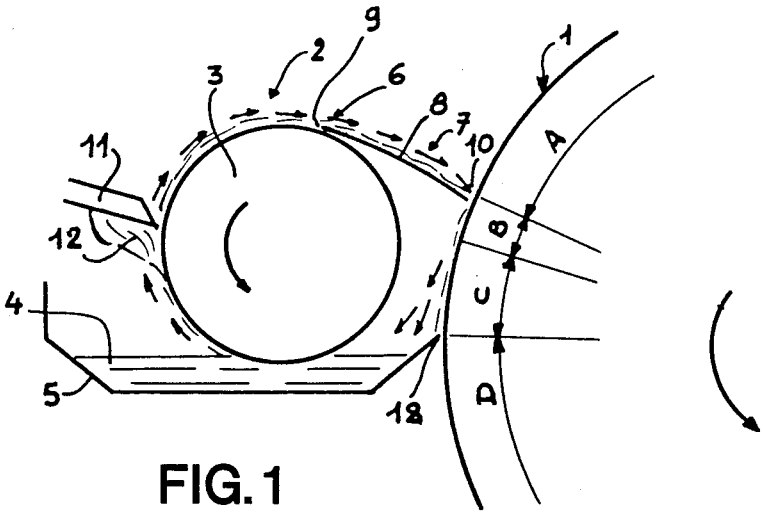
FIG. 1 is a view in section, through a plane perpendicular to the magnetic drum, of a first embodiment of the device according to the invention, containing a magnetic brush.

In the embodiment shown in FIG. 1, the device for developing a latent image formed on a magnetic surface (1), by means of a magnetic developing powder, in order to form a powder image, contains means (2) for causing the developing powder to flow onto the magnetic surface (1) uninfluenced by a magnetic field other than that present on the magnetic surface (1).

The means (2) for causing the developing powder to flow onto the magnetic surface (1) contain magnetic means (3) which, in the present embodiment, consist of a magnetic brush of the type comprising rotating magnets and a fixed envelope, part of the outer surface of the magnetic means (3) being in contact with the developing powder (4) contained in a trough (5) so as to remove the said powder, means (6) for detaching the powder from the magnetic means (3), and means (7) for bringing the powder into the vicinity of the magnetic surface (1).

In the embodiment shown of the device forming the subject of the invention, the means (6) for detaching the developing powder from the magnetic means (3), and the means (7) for bringing the powder into the vicinity of the magnetic surface (1), consist of a channel (8) whose general shape is inclined towards the magnetic surface (1).

The channel (8) can consist of an elongate metal sheet whose edges (9) and (10) are parallel to the magnetic brush (3) and to the magnetic surface (1) over the whole length of the respective generatrices of the magnetic brush (3) and the magnetic surface (1).

The distance between the edge (10) of the channel (8) and the magnetic surface (1) is chosen in such a way as to allow the developing powder (4) to flow between the edge (10) and the magnetic surface (1); it can be of the order of 1 to 2 mm.

The distance between the edge (9) of the channel (8) and the surface of the brush (3) is very small so that the edge (9) is virtually in contact with the surface of the magnetic brush (3), thus enabling it to be a doctor for the latter and to detach the developing powder (4) during the rotation of the magnetic brush (3) while at the same time allowing the magnetic brush (3) to rotate without damaging its surface.

The device according to the present embodiment also contains a scraper (11) associated with the magnetic means (3). The purpose of the scraper (11) is to equalize the thickness of the layer of developing powder (4) brought by the magnetic means (3), and it prevents any aggregates present in the developing powder (4) contained in the trough (5) from being carried towards the channel (8), the said aggregates being retained at (12).

The edge (18) of that wall of the trough (5) which is located in the vicinity of the magnetic surface (1) comes virtually into contact with the magnetic surface (1) so as to recover the developing powder (4) which has not been attracted by the magnetic surface (1), and to recycle this powder to the trough (5).

The directions of rotation of the magnetic surface (1) and the magnets of the magnetic brush (3) are indicated in FIG. 1, to which reference will be made in order to understand the process for developing a latent image formed on a magnetic surface, by means of a magnetic developing powder, using the developing device according to this first embodiment.

With the magnets of the magnetic brush (3) and also the magnetic surface (1) rotating, the developing powder (4) present in the trough (5) is removed by means of the magnetic brush (3), part of the outer surface of which is in contact with the developing powder (4) contained in the trough (5). Under the influence of the magnets of the magnetic brush (3), the developing powder (4) moves on the surface of the magnetic brush (3) in the direction of the arrows shown in FIG. 1. During the movement of the developing powder, the scraper (11) retains at (12) any aggregates present in the developing powder (4) and equalizes the thickness of the layer of developing powder carried by the brush.

The developing powder (4) is detached from the surface of the magnetic brush (3) by means of the doctor formed by the edge (9) of the channel (8). When detached, the developing powder (4) is brought by means of the channel (8), of inclined general shape, towards the magnetic surface (1), where it flows freely onto the magnetic surface (1), between the edge (10) of the channel and the magnetic surface (1), sweeping the latter and being uninfluenced by a magnetic field other than the magnetic field present on the magnetic surface (1).

The latent image previously formed by suitable means on the magnetic surface (1), and present in zone A of the latter, is brought into zone B by the rotation of the magnetic surface (1), zone B being the free flow zone of the magnetic developing powder (4).

The particles of the flowing magnetic developing powder are then subjected only to the influence of the magnetic field forming the latent image present on the magnetic surface, and are retained by the latter.

The latent image present on the magnetic surface (1) has therefore become a powder image during its passage into zone B, and the latent image has been developed by means of the magnetic developing powder.

The powder image is brought into zone C by the rotation of the magnetic surface (1), zone C being the zone in which the distance between the magnetic brush (3) and the magnetic surface (1) is smallest, the excess particles of magnetic developing powder are attracted to a considerable extent by the magnetic brush (3), and the image which appears in zone D is thus a powder image ready to be transferred onto a substrate.

Figure 2:
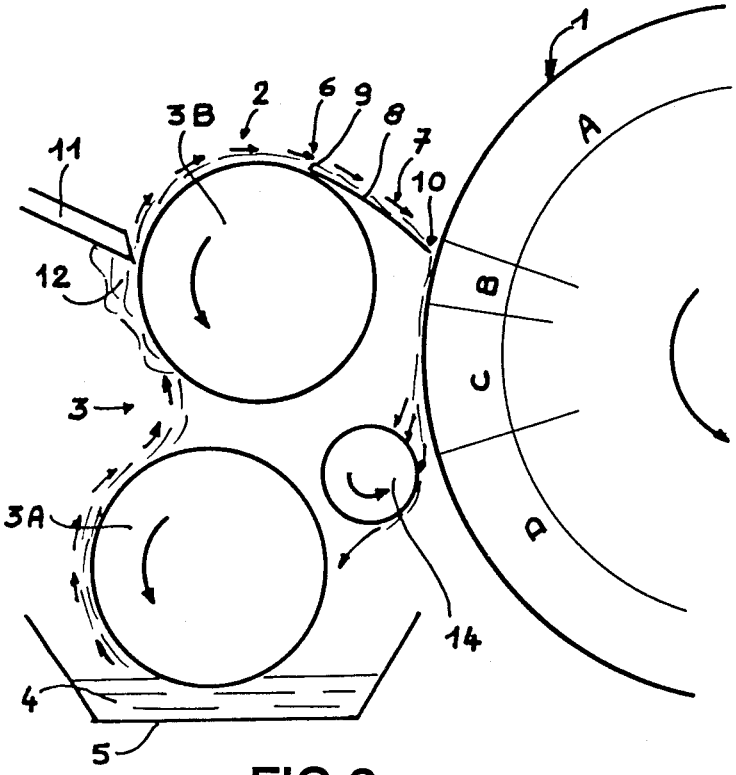
FIG. 2 is a view in section, through a plane perpendicular to the magnetic drum, of a second embodiment of the device forming the subject of the invention.

FIG. 2 shows another embodiment of the device for developing a latent image formed on a magnetic surface, by means of a magnetic developing process.

In this embodiment, the magnetic means (3) consist of two magnetic brushes (3A, 3B) placed in such a way that the second magnetic brush (3B) is located at a greater height than the first magnetic brush (3A), that part of the outer surface of the first magnetic brush (3A) is in contact with the developing powder (4) contained in the trough (5), and that the magnetic field generated by the first magnetic brush (3A) on the surface of the second magnetic brush (3B) is weaker than the coercive field on the surface of the second magnetic brush (3B).

Like the device described above, the device according to the present embodiment contains a scraper (11) for equalizing the thickness of the layer of developing powder (4) on the surface of the second magnetic brush (3B), and a channel (8), whose general shape is inclined towards the magnetic surface (1), for bringing the developing powder into the vicinity of the magnetic surface (1), the edge (9) of the channel (8) also constituting a doctor for detaching the developing powder (4) from the second magnetic brush (3B).

The device according to this embodiment also contains means for removing the excess developing powder (4) from the powder image. These means consist of another magnetic brush (14).

The magnetic brush (14) is such that, on the one hand, the magnetic field generated on the magnetic surface (1) is sufficiently weak not to damage the powder image present on the magnetic surface (1), while at the same time being sufficiently strong to attract the excess developing powder (4) from the powder image, and that, on the other hand, the magnetic field generated by the magnetic brush (14) on the surface of the first magnetic brush (3A) is weaker than the coercive field on the surface of the first magnetic brush (3A), so that the developing powder is transferred from the magnetic brush (14) to the first magnetic brush (3A) and is thus recycled.

The directions of rotation of the magnetic surface (1) and the magnets of the two magnetic brushes (3A) and (3B) are indicated in FIG. 2, to which reference will be made in order to understand the process for developing a latent image formed on a magnetic surface, by means of a magnetic developing powder, using the developing device according to this second embodiment.

With the magnets of the two magnetic brushes (3A) and (3B) and of the magnetic brush (14) and also the magnetic surface (1) rotating, the developing powder (4) present in the trough (5) is removed by means of the first magnetic brush (3A), part of the outer surface of which is in contact with the powder (4) contained in the trough (5). Under the influence of the magnets of the first magnetic brush (3A), the developing powder (4) moves on the surface of the latter in the direction of the arrows shown in FIG. 2.

As the magnetic field generated by the first magnetic brush (3A) on the surface of the second magnetic brush (3B) is weaker than the coercive field on the surface of the second magnetic brush (3B), the developing powder (4) carried by the first magnetic brush leaves the first magnetic brush (3A) on arriving in the vicinity of the second magnetic brush (3B), and is transferred onto the second magnetic brush (3B).

Under the influence of the magnets of the second magnetic brush (3B), the developing powder (4) moves on the surface of the latter in the direction of the arrows shown in FIG. 2. During the movement of the developing powder, the scraper (11) retains at (12) any aggregates present in the developing powder (4) and equalizes the thickness of the layer of developing powder carried by the brush.

The developing powder (4) is detached from the surface of the second magnetic brush (3B) by means of the doctor formed by the edge (9) of the channel (8). When detached, the developing powder (4) is brought by means of the channel (8), of inclined general shape, towards the magnetic surface (1), where it flows freely onto the magnetic surface (1), between the edge (10) of the channel and the magnetic surface (1), sweeping the latter and being uninfluenced by a magnetic field other than the magnetic field present on the magnetic surface (1).

The latent image previously formed by suitable means on the magnetic surface (1), and present in zone A of the latter, is brought into zone B by the rotation of the magnetic surface (1), zone B being the free flow zone of the magnetic developing powder (4).

The particles of the flowing magnetic developing powder are then subjected only to the influence of the magnetic field of the latent image present on the magnetic surface, and are retained by the latter.

The latent image present on the magnetic surface (1) has therefore become a powder image during its passage into zone B, and the latent image has been developed by means of the magnetic developing powder.

The powder image is brought into zone C by the rotation of the magnetic surface (1); when the powder image arrives in the vicinity of the magnetic brush (14), the excess particles of magnetic developing powder are attracted to a considerable extent by the magnetic field of the magnetic brush (14) and are then transferred to the magnetic brush (3A) and recycled. The image which appears in zone D is a powder image ready to be transferred onto a substrate.

The magnetic brush (14) can also rotate in the opposite direction to that indicated in FIG. 2. In this variant, the excess particles of magnetic developing powder which have been attracted by the magnetic field of the magnetic brush (14) can be recycled directly to the magnetic brush (3B). An inclined ramp, similar to that described below, can facilitate the transfer of the developing powder from the magnetic brush (14) to the magnetic brush (3B).

Figure 3:
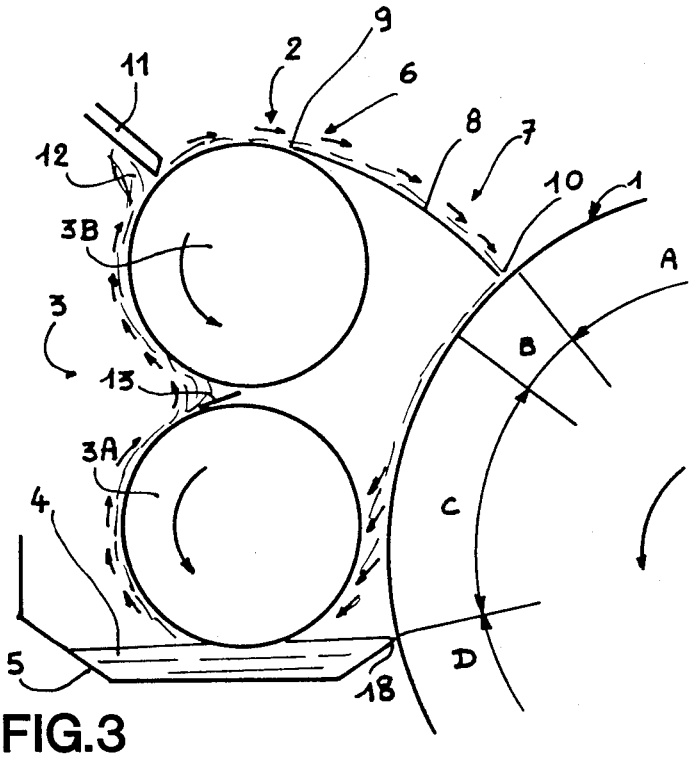
FIG. 3 is a view in section, through a plane perpendicular to the magnetic drum, of a third embodiment of the device according to the invention.

FIG. 3 shows yet another embodiment of the device for developing a latent image formed on a magnetic surface, by means of a magnetic developing process.

The developing device according to this embodiment is similar to the device described above and shown in FIG. 2. Like the latter, it contains a first magnetic brush (3A) and a second magnetic brush (3B), a scraper (11) and a channel (8).

Moreover, the device according to this embodiment contains means for guiding the developing powder (4) as it passes from the first magnetic brush (3A) to the second magnetic brush (3B), these guide means consisting of a ramp (13) inclined approximately along the inner tangent to the two brushes (3A, 3B).

In contrast to the device according to the embodiment shown in FIG. 2, the device according to this embodiment does not contain means consisting of another magnetic brush (14) for removing the excess developing powder from the powder image. The device, forming the subject of the invention, shown in FIG. 3 is such that the means for removing the excess developing powder consist of the first magnetic brush (3A).

As in the embodiment described above, the two magnetic brushes (3A, 3B) are placed in such a way that the second magnetic brush (3B) is located at a greater height than the first magnetic brush (3A), that part of the outer surface of the first magnetic brush (3A) is in contact with the developing powder (4) contained in the trough (5), and that the magnetic field generated by the first magnetic brush (3A) on the surface of the second magnetic brush (3B) is weaker than the coercive field on the surface of the second magnetic brush (3B).

Also in the present embodiment, the first magnetic brush (3A) is such that the magnetic field generated on the magnetic surface (1) is sufficiently weak not to damage the powder image present on the magnetic surface (1), while at the same time being sufficiently strong to attract the excess developing powder (4) from the powder image.

The process for developing a latent image formed on a magnetic surface, by means of a magnetic developing powder, using the developing device according to this third embodiment is similar to the developing process using the developing device according to the second embodiment. The difference lies in the fact that, when the powder image arrives in the vicinity of the first magnetic brush (3A), the excess particles of magnetic developing powder are attracted to a considerable extent by the magnetic field of the first magnetic brush (3A) instead of being attracted by the magnetic brush (14).

Figure 4:
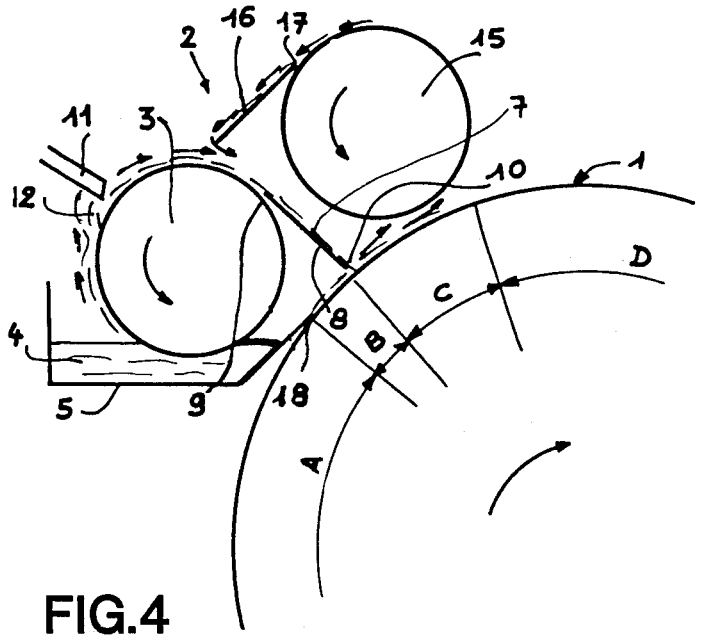
FIG. 4 is a view in section, through a plane perpendicular to the magnetic drum, of a fourth embodiment of the device forming the subject of the invention.

FIG. 4 shows another embodiment of the device for developing a latent image formed on a magnetic surface, by means of a magnetic developing process.

Like the device shown in FIG. 1, the device according to this embodiment contains means (2) for causing the developing powder to flow, these means (2) consisting of a magnetic brush (3), part of the outer surface of which is in contact with the developing powder (4) contained in a trough (5), means (6) for detaching the powder from the magnetic brush (3) and bringing it into the vicinity of the magnetic surface (1), these means (6) consisting of a channel (8), and a scraper (11).

The device according to this embodiment also contains means for removing the excess developing powder (4) from the powder image, these means consisting of another magnetic brush (15) placed in such a way that the magnetic brush (3) and the magnetic brush (15) are located on either side of the channel (8).

The magnetic brush (15) is such that the magnetic field generated on the magnetic surface (1) is sufficiently weak not to damage the powder image present on the magnetic surface (1), while at the same time being sufficiently strong to attract the excess developing powder (4) from the powder image.

Associated with the magnetic brush (15), there is a doctor plate (16) whose edge (17), which is approximately parallel to the generatrices of the magnetic brush (15) and located at a very short distance from the latter, detaches from the magnetic brush (15) the developing powder collected from the powder image. The doctor plate (16) is inclined towards the magnetic brush (3) so as to recycle the developing powder to the magnetic brush (3).

The directions of rotation of the magnetic surface (1) and the magnets of the magnetic brush (3) and of the magnetic brush (15) are indicated in FIG. 4, to which reference will be made in order to understand the process for developing a latent image formed on a magnetic surface, by means of a magnetic developing powder, using the developing device according to this embodiment.

With the magnets of the two magnetic brushes (3) and (15) and also the magnetic surface (1) rotating, the developing powder (4) present in the trough (5) is removed by means of the magnetic brush (3), part of the outer surface of which is in contact with the powder (4) contained in the trough (5). Under the influence of the magnets of the magnetic brush (3), the developing powder (4) moves on the surface of the latter in the direction of the arrows shown in FIG. 4.

During the movement of the developing powder, the scraper (11) retains at (12) any aggregates present in the developing powder (4) and equalizes the thickness of the layer of developing powder carried by the brush.

The developing powder (4) is detached from the surface of the magnetic brush (3) by means of the doctor formed by the edge (9) of the channel (8). When detached, the developing powder (4) is brought by means of the channel (8), of inclined general shape, towards the magnetic surface (1), where it flows freely onto the magnetic surface (1), between the edge (10) of the channel and the magnetic surface (1), sweeping the latter and being uninfluenced by a magnetic field other than the magnetic field present on the magnetic surface (1).

The latent image previously formed by suitable means on the magnetic surface (1), and present in zone A of the latter, is brought into zone B by the rotation of the magnetic surface (1), zone B being the free flow zone of the magnetic developing powder (4).

The particles of the flowing magnetic developing powder are then subjected only to the influence of the magnetic field of the latent image present on the magnetic surface, and are retained by the latter.

The latent image present on the magnetic surface (1) has therefore become a powder image during its passage into zone B, and the latent image has been developed by means of the magnetic developing powder.

The powder image is brought into zone C by the rotation of the magnetic surface (1); when the powder image arrives in the vicinity of the magnetic brush (15), the excess particles of magnetic developing powder are attracted to a considerable extent by the magnetic field of the magnetic brush (15), and the image which appears in zone D is thus a powder image ready to be transferred onto a substrate.

Of course, the invention is in no way limited to the embodiments specifically described in the present account, and it is possible to adopt variants or improvements relating to the various steps of the process and the various means used, without thereby exceeding the scope of the present invention.

The process for developing a latent image formed on a magnetic surface, by means of a magnetic developing powder, in order to form a powder image, and the device for carrying out this process, both of which form subjects of the invention, have numerous advantages.

Thus, the process and the device for carrying it out have the advantage of faithfully reproducing the latent image; in fact, the latter is not subjected to a magnetic field likely to damage it.

The process and the device also have the advantage of allowing efficient mixing of the developing powder in the reservoir.

Another important advantage of the process and device according to the invention for developing a latent image on a magnetic surface is the good quality of the printing obtained on a substrate with a printing apparatus containing this device. This good printing quality is due to the cleaning of the powder image zone in order to remove the excess powder which may be present, before the powder image is transferred onto the substrate.

We claim:

1. A process for developing a latent image formed on a magnetic surface, by means of a magnetic developing powder, in order to form a powder image, which comprises taking the powder from a trough by magnetic means, detaching the powder from the magnetic means and, when detached, freely flowing the detached powder into the vicinity of the magnetic surface so that it flows freely onto the magnetic surface under the influence of the magnetic field produced by the magnetic surface.

2. The developing process according to claim 1. which further comprises removing the excess powder from the powder image by transferring the excess powder from the magnetic surface to another magnetic means under the influence of the magnetic field of the other means.

3. The developing process according to claim 1 or claim 2, which comprises taking the developing powder from a trough by a first magnetic means, transferring from the first magnetic means the powder to a second magnetic means, detaching the powder from the second magnetic means and, when detached, freely flowing detached powder into the vicinity of the magnetic surface so that it flows freely onto the magnetic surface uninfluenced by the first and second magnetic means, and removing the excess powder from the powder image by transferring the excess powder from the magnetic surface to the first magnetic means under the influence of the magnetic field of the first magnetic means.

4. The developing process according to claim 1 or claim 2, which comprises taking the developing powder from a trough by a first magnetic means, detaching the powder from the first magnetic means and, when detached, freely flowing the powder into the vicinity of the magnetic surface so that it flows freely onto the magnetic surface under the influence of the magnetic field produced by the magnetic surface and removing the excess powder from the powder image by transferring the excess powder from the magnetic surface to another magnetic means under the influence of the other magnetic means and recovering and recycling removed powder by the other magnetic means to the first magnetic means.

5. A process of forming a powder image by developing a latent image on a magnetic surface with a magnetic developing powder which process comprises magnetically attracting said powder from a source of supply thereof using magnetic means, detaching said powder from said magnetic means, and freely flowing the detached powder into the vicinity of the magnetic surface whereby the powder is magnetically attracted to the magnetic surface under the influence of the magnetic field produced by the magnetic surface whereby the magnetic developing powder flows onto and over the magnetic surface to develop the latent image forming a powder image thereof.

6. The process of claim 5 wherein the magnetic means comprises a magnetic brush, said process comprising rotating said magnetic brush in the magnetic powder whereby said powder forms a powder layer on the rotating brush, scraping said powder layer off of said rotating brush with a first end of a downwardly inclined scraping means to the vicinity of the magnetic surface whereby said powder freely flows across the space between the scraping means and the magnetic surface and then freely flows onto the magnetic surface under the influence of the magnetic field produced by the magnetic surface.

7. The process of claim 5 or claim 6 which further comprises removing excess powder from the powder image formed on the magnetic surface.

8. The process of claim 7, wherein the step of removing comprises attracting the excess powder with magnetic means spaced from the magnetic surface.

9. The process of claim 8, wherein the magnetic brush comprises the magnetic means spaced from the magnetic surface.

10. The process of claim 8, wherein the magnetic means spaced from the magnetic surface comprises second magnetic means provided in closer proximity to the powder image than the magnetic means used to attract the magnetic powder from said source.

11. The process of claim 5 which comprises magnetically attracting the magnetic powder from a supply thereof to a first magnetic means, transferring the powder from the first magnetic means to second magnetic means, separating the powder from the second magnetic means, freely flowing the detached powder into the vicinity of the magnetic surface so that it freely flows onto the magnetic surface under the influence of the magnetic field produced by the magnetic surface to thereby form a powder image corresponding to the latent image, and removing excess powder on the magnetic surface by magnetically attracting the excess powder to magnetic means provided in the vicinity of the powder image bearing portion of the magnetic surface.

12. The process of claim 11, wherein the first magnetic means comprises the magnetic means provided in the vicinity of the powder image bearing surface portion.

13. The process of claim 11, wherein the magnetic means provided in the vicinity of the powder image bearing surface portion comprises third magnetic means, said third magnetic means being located between the first magnetic means and said magnetic surface, the magnetic field generated by the third magnetic means on the surface of the first magnetic means being weaker than the coercive field on the surface of the first magnetic means, whereby the excess powder removed from the magnetic surface by the third magnetic means is transferred to the first magnetic means.

14. The process of claim 6, wherein the distance between the opposite end of the scraping means and the magnetic surface is about 1 to about 2 millimeters.

15. A device for developing a latent image formed on a magnetic surface, by means of a magnetic developing powder in order to form a powder image comprising magnetic means for taking the powder from a trough, means for detaching the powder from the magnetic means and means for flowing freely the powder into the vicinity of the magnetic surface so that it flows freely onto the magnetic surface under the influence of the magnetic field produced by the magnetic surface.

16. The device according to claim 15, wherein the means for detaching the powder from the magnetic means, and the means for flowing freely the powder into the vicinity of the magnetic surface, comprise a channel inclined towards the magnetic surface and of which the edge opposite the magnetic surface is a doctor for the magnetic means.

17. The device according to either one of claims 15 or 16, wherein the magnetic means comprises at least one magnetic brush.

18. The device according to claim 17, which further comprises a trough for storing a supply of said magnetic powder and wherein during operation of said device, a portion of the outer surface of a magnetic brush is in contact with developing powder contained in said trough.

19. The device according to claim 17, which comprises first and second magnetic brushes, the second magnetic brush being located at a greater height than the first magnetic brush, wherein the magnetic field generated by the first magnetic brush on the surface of the second magnetic brush being weaker than the coercive field on the surface of the second magnetic brush, and wherein a portion of the outer surface of the first magnetic brush is in contact with developing powder contained in said trough, whereby powder attracted to the outer surface of the first magnetic brush will be transferred to the second magnetic brush under the influence of the magnetic field thereof.

20. The device according to claim 19, where the first and second magnetic brushes have identical coercive fields.

21. The device according to claim 19, wherein the first and second magnetic brushes have different coercive fields.

22. The device according to claim 19, which further comprises means for guiding the developing powder as it passes from the first magnetic brush to the second magnetic brush.

23. The device according to claim 22, wherein the guide means comprises a ramp inclined approximately along the inner tangent to the first and second magnetic brushes.

24. The device according to claim 15, which further comprises means for removing excess developing powder from the powder image.

25. The device according to claim 22, wherein the means for removing the excess powder comprises a magnetic brush.

26. The device according to claim 19 which further comprises means for removing excess developing powder from the powder image.

27. The device according to claim 26, wherein the means for removing the excess powder comprises the first magnetic brush.

28. In a printing apparatus for printing a magnetic developing powder image on a substrate, said apparatus including a magnetic surface, means to form a latent magnetic image on the magnetic surface, developing means for developing the latent magnetic image into a powder image, and transfer means for transfering the powder image to a printing substrate, the improvement wherein the developing means comprises storage means for storing magnetic developing powder, magnetic means for magnetically attracting the magnetic powder from the storage means, detaching means for separating the powder from the magnetic means, and flow means for freely flowing the separated powder into the vicinity of the magnetic surface under the influence of the magnetic field produced by the magnetic surface.

* * * * *